US008162081B2

(12) United States Patent
Ballard et al.

(10) Patent No.: US 8,162,081 B2
(45) Date of Patent: Apr. 24, 2012

(54) FORCE BALANCED ASYMMETRIC DRILLING REAMER AND METHODS FOR FORCE BALANCING

(75) Inventors: Brian D. Ballard, La Porte, TX (US); William W. King, Houston, TX (US)

(73) Assignee: Varel International Ind., L.P., Carrollton, TX (US)

( * ) Notice: Subject to any disclaimer, the term of this patent is extended or adjusted under 35 U.S.C. 154(b) by 329 days.

(21) Appl. No.: 12/541,591

(22) Filed: Aug. 14, 2009

(65) Prior Publication Data

US 2010/0051349 A1 Mar. 4, 2010

Related U.S. Application Data

(60) Provisional application No. 61/092,639, filed on Aug. 28, 2008.

(51) Int. Cl.
*E21B 10/26* (2006.01)
*E21B 7/00* (2006.01)

(52) U.S. Cl. ..... 175/325.2; 175/57; 175/406

(58) Field of Classification Search ..... 175/57, 175/325.2, 320, 385, 406, 408
See application file for complete search history.

(56) References Cited

U.S. PATENT DOCUMENTS

| | | | | |
|---|---|---|---|---|
| RE29,151 | E * | 3/1977 | McCaleb | 175/57 |
| 4,467,879 | A | 8/1984 | Burge | 175/325.4 |
| 4,512,425 | A | 4/1985 | Brock | 175/430 |
| 4,610,316 | A | 9/1986 | Boaz | 175/323 |
| 5,010,789 | A | 4/1991 | Brett et al. | 76/108.2 |
| 5,330,016 | A | 7/1994 | Paske et al. | 175/320 |
| 5,937,957 | A | 8/1999 | Swietlik | 175/323 |
| 5,992,548 | A * | 11/1999 | Silva et al. | 175/391 |
| 2002/0125047 | A1 * | 9/2002 | Beaton | 175/406 |
| 2004/0222025 | A1 * | 11/2004 | Beaton | 175/406 |

FOREIGN PATENT DOCUMENTS

| | | |
|---|---|---|
| EP | 1811124 | 7/2007 |
| EP | 1811125 | 7/2007 |
| EP | 1811126 | 7/2007 |
| EP | 1818501 A2 * | 8/2007 |
| GB | 2041427 | 9/1980 |

* cited by examiner

*Primary Examiner* — Jennifer H Gay
*Assistant Examiner* — Catherine Loikith
(74) *Attorney, Agent, or Firm* — King & Spalding LLP

(57) ABSTRACT

A force balanced asymmetric drilling reamer comprising a plurality of blades, each blade having at least one cutter section and a gage section. The cutter section is designed to have a plurality of cutting devices for cutting through swelling formations and cutting free sloughing formations. The gage section has a full bore diameter with gage elements flushly coupled to gage section's outer surface. The blades may be curve/concave shaped or boomerang/chevron shaped, which thereby agitate the cutting beds. At least a portion of the drilling reamer's diameter is incrementally force balanced, starting from the outermost diameter, so that the net radial force is less than 10% of weight on bit with respect to the center of rotation. This balancing allows a greater cutter longevity and provides for a better wellbore condition. Optionally, at least a portion of the drilling reamer's surface may be treated by nitriding for repelling the cuttings.

47 Claims, 3 Drawing Sheets

FORCE BALANCED ASYMMETRIC DRILLING REAMER AND METHODS FOR FORCE BALANCING

CROSS-REFERENCE TO RELATED APPLICATIONS

This application claims the benefit of U.S. Provisional Patent Application No. 61/092,639, entitled "Force Balanced Asymmetric Drilling Reamer," filed Aug. 28, 2008, the entirety of which is incorporated by reference herein.

BACKGROUND OF THE INVENTION

This invention relates generally to downhole drilling in subterranean formations and, more particularly, to a hole opening tool and to methods of making the hole opening tool.

In the exploration of oil, gas and geothermal energy, drilling operations are used to create boreholes in the earth. One type of drilling operation includes rotary drilling. According to rotary drilling, the borehole is created by rotating a tubular drill string which has a drill bit coupled to one end. The drill bit engages a formation and produces a borehole of equivalent diameter to the drill bit as the drill bit proceeds downward. As the drill bit rotates and deepens the borehole, additional drill pipe sections are coupled to the end that does not have the drill bit so that the drill bit may further deepen the borehole. Typically, various components comprise the Bottom Hole Assembly ("BHA"). These may include, but are not limited to, measurement while drilling ("MWD") tools, logging while drilling ("LWD") tools, drill collars, downhole motors ("DHM"), and rotary steerable tools coupled to the drill string and located within the borehole above the drill bit.

During drilling operations, these BHA components are oftentimes subjected to constrictions in the wellbore brought on by various conditions. These constrictions may be found anywhere in the open hole wellbore. One such condition arises when the soil around the borehole swells thereby causing a constriction within the borehole. As the drill bit advances through the borehole, the soil above the drill bit may become exposed to moisture levels that may otherwise not prevail, thereby causing the soil to hydrate and swell. Another such condition arises when cuttings settle on the low side of the hole in high angle and lateral boreholes. These cuttings cause the borehole diameter to be constricted in the areas of the cutting settlings. Another such condition arises when sloughing occurs in some vertical or near vertical wellbores. In this situation, chunks of the borehole wall become dislodged above the BHA or around the BHA and fall to the top of the BHA or the drill bit. Thus, a blockage or constriction in the borehole is created. These conditions are but a few of the conditions that may cause constrictions within the wellbore.

These constrictions may cause difficulties during the drilling process, which includes retrieving the drill bit and other BHA components from the borehole. Since these components are very costly, it would be advantageous to be able to remove the BHA and drill bit while spending the least amount of downtime while doing so. Additionally, as constrictions form in the wellbore, problems may arise during the forward advancement of the drill bit through the borehole. Thus, a tool for opening these constrictions would facilitate the drilling process.

Prior systems have attempted to deal with some of these problems through the use of roller reamers and string reamers. Prior art reamers typically have active cutting gage sections, either through rollers or through active tungsten carbide cutting structures at the full hole gage sections. Prior art reamers have always been symmetrical in their construction with evenly spaced rollers or reaming blades. A known problem with symmetrical tools is that they can develop a lobe patterned lateral movement cycle that can damage the tools and the condition of the borehole wall. A further problem with prior art string reamers is that they have not had the benefit of force balancing techniques that help to control unwanted lateral oscillations from developing during the course of interaction between the tool and a constricted wellbore. U.S. Pat. No. 5,010,789 (the "'789 Patent"), issued to Brett et al. on Apr. 30, 1991, discloses a method of making imbalanced compensated drill bits. The teachings disclosed in the '789 Patent are incorporated by reference herein.

Additionally, some tools have been recently developed to address the problem of cuttings settling in high angle or lateral hole sections. These tools seek to stir up the cuttings bed by using paddles or chevron-shaped upsets on a sub, or on a piece of drill pipe. However, these cutting bed tools are incapable of addressing the problems of swelling formations.

In view of the foregoing discussion, need is apparent in the art for a tool that can effectively cut swelling formation while doing minimal damage to competent and full diameter borehole walls. Additionally, there is also a need for a tool that can effectively plow out cuttings beds while doing minimal damage to competent and full diameter borehole walls. Furthermore, there also is a need for a tool that can effectively cut free sloughing formations while doing minimal damage to competent and full diameter borehole walls. A technology addressing one or more such needs, or some other related shortcoming in the field, would benefit downhole drilling, for example creating boreholes more effectively and more profitably. This technology is included within the current invention.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

Figure 1:
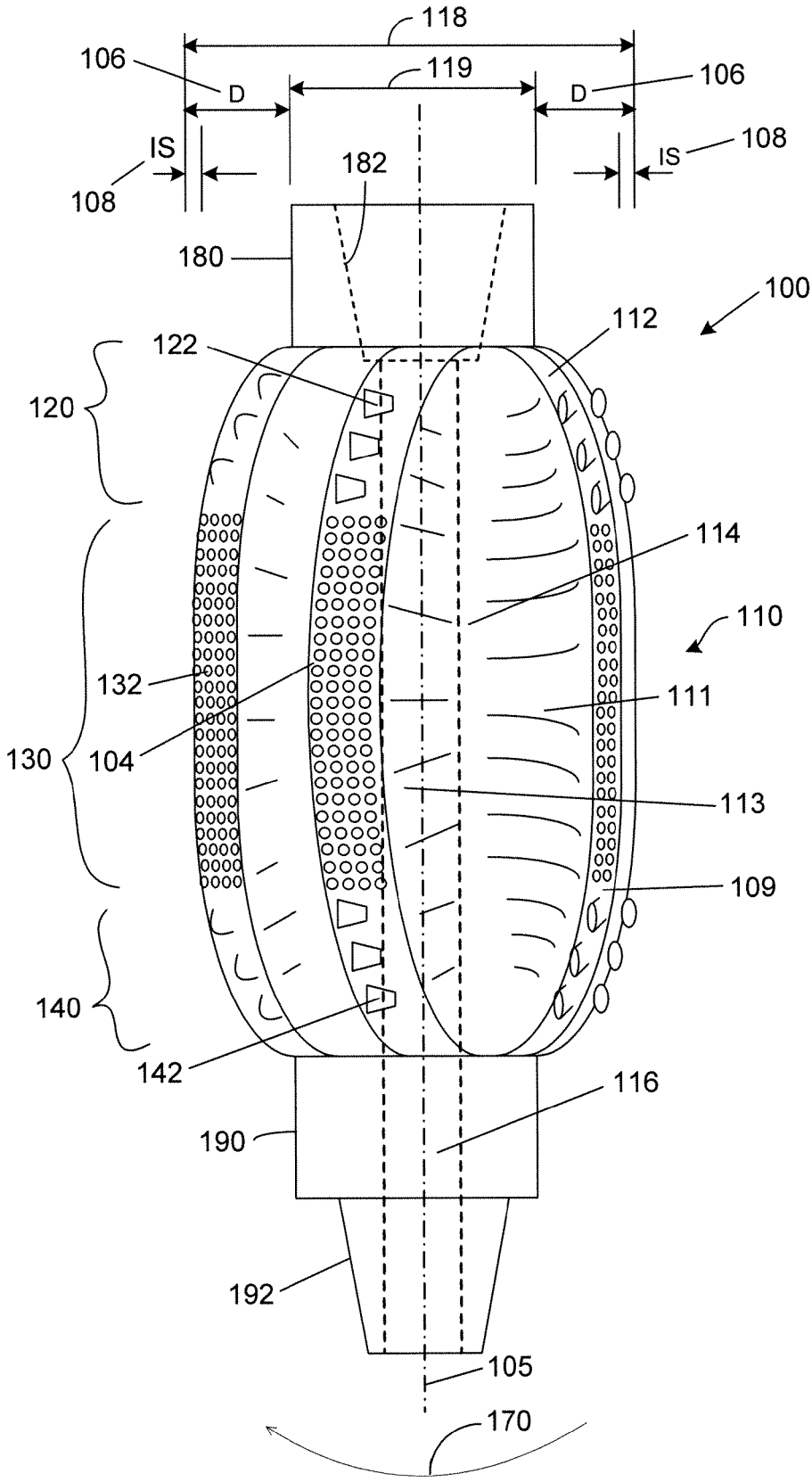
FIG. 1 shows a side view of a force balanced asymmetric drilling reamer in accordance with an exemplary embodiment.

FIG. 1 shows a side view of a force balanced asymmetric drilling reamer 100 in accordance with an exemplary embodiment. The force balanced asymmetric drilling reamer 100 includes a body 110 having a center of rotation axis 105, a bore channel 116 for passage of drilling fluids there through, a first connection end 180, and a second connection end 190. The bore channel 116 is created longitudinally parallel to the center of rotation axis 105 and is dimensioned to a desired size to allow smooth passage of drilling fluids there through. The center of rotation axis 105 passes within the bore channel 116. Some factors influencing the size of the bore channel 116 includes, but is not limited to, drill string size, wellbore diameter, and the properties of the drilling fluids. In an exemplary embodiment, the bore channel 116 has a circular geometric shape. However, it is understood that bore channels having alternative geometric shapes, including but not limited to square and rectangular geometric shapes, are within the scope and spirit of the exemplary embodiment.

The body 110 includes a plurality of blades 112 and a plurality of passageways 114, wherein each of the plurality of passageways 114 is positioned between each of the plurality of blades 112. These plurality of blades 112 may be coupled to the body 110 or may be integrally formed into the body 110. Additionally, the plurality of blades 112 may be curve shaped as shown in FIG. 1, or may have alternative shapes, including but not limited to straight shaped, spiraled, or boomerang/chevron shaped, without departing from the scope and spirit of the exemplary embodiment. According to this embodiment, the plurality of blades 112 are curved shaped, wherein the apex 104 of the curve shape is located in the direction of rotation 170. Although the apex 104 has been illustrated as being located in the direction of rotation 170, the apex 104 may be located away from the direction of rotation 170 without departing from the scope and spirit of the exemplary embodiment.

Each of the plurality of blades 112 comprises a front rotational side 111 located on the side facing the direction of rotation 170, a blade cutting surface 109, and a rear rotational side 113 located on the side facing away from the direction of rotation 170. According to the embodiment shown in FIG. 1, the front rotational side 111 may have a scoop-shape or concave shape, which thereby allows the force balanced asymmetric drilling reamer 100 to behave as an agitator. The front rotational side 111 scoops up the drilling fluids and cutting settlings located in the wellbore and creates turbulence to prevent and/or clear constrictions caused by cutting settlings. These cutting settlings may then be allowed to travel back to the surface of the wellbore or to any other location where drilling fluids are processed. The rear rotational side 113 is illustrated to be linear, which may either proceed directly towards the center of rotation axis 105 or may proceed angularly with respect to the center of rotation axis 105. Although this embodiment shows the rear rotational side 113 to be linear and proceeding angularly with respect to the center of rotation axis 105, the rear rotational side 113 may alternatively be concave shaped, convex shaped, or a combination of concave shaped, convex shaped, and linear without departing from the scope and spirit of the exemplary embodiment. Additionally, the shapes of the front rotational side 111 and the rear rotational side 113 may be switched such that the front rotational side 111 has a convex shape or straight shape, in lieu of the concave shape, without departing from the scope and spirit of the exemplary embodiment.

Each of the blade cutting surface 109 for the plurality of blades 112 comprises a first cutter section 120, a second cutter section 140, and a gage section 130 positioned between the first cutter section 120 and the second cutter section 140. The first cutter section 120 is distally located to the drill bit (not shown) and the second cutter section 140 is proximally located to the drill bit (not shown) when the force balanced asymmetric drilling reamer 100 is coupled along the drill string (not shown). According to some embodiments, the force balanced asymmetric drilling reamer 100 is located approximately between 100 feet to approximately 200 feet above the drill bit (not shown). Although one example has been provided for a distance typically separating the drill bit (not shown) and the force balanced asymmetric drilling reamer 100, the separation distance may be shorter or longer depending upon the requirements of the application without departing from the scope and spirit of the exemplary embodiment.

According to the embodiment shown, the first cutter section 120 and the second cutter section 140 are both convex shaped and extend from the gage section 130 to the first connection end 180 and the second connection end 190, respectively. The diameter of the gage section 130 is larger than the diameters of the first connection end 180 and the second connection end 190. Although the first cutter section 120 and the second cutter section 140 are illustrated as having a concave shape, the first cutter section 120 and the second cutter section 140 may be tapered, or include alternative means of reducing the outer diameter of the body 110 while proceeding from the gage section 130 to the first connection end 180 and the second connection end 190, without departing from the scope and spirit of the exemplary embodiment. In certain embodiments, one cutter section may be tapered while the other cutter section is convex shaped without departing from the scope and spirit of the exemplary embodiment. The first cutter section 120 and the second cutter section 140 have a reduced diameter relative to the gage section 130 of the body 110.

The outer surfaces of the first cutter section 120 and the second cutter section 140 comprise a plurality of cutter devices 122, 142, which can deform the earth formation by scraping and shearing. These plurality of cutter devices 122, 142 may be radially and vertically staggered on the outer surfaces of the first cutter section 120 and the second cutter section 140. Additionally, these plurality of cutter devices 122, 142 are substantially exposed above the outer surfaces of the first cutter section 120 and the second cutter section 140 to provide maximum effectiveness in opening bore constrictions. Although these plurality of cutter devices 122, 142 have been described as being radially and vertically staggered, the plurality of cutter devices 122, 142 may be only vertically staggered, only radially staggered, or having a staggered positioning on only one of the cutter sections, without departing from the scope and spirit of the exemplary embodiment. It is understood that the number and orientation of the cutter devices 122, 142 may be greater or fewer than from that shown in the accompanying figure without departing from the scope and spirit of the exemplary embodiment.

The cutting edge of the plurality of cutter devices 122, 142 may be made from hard cutting elements, such as natural or synthetic diamonds. The cutter devices made from synthetic diamonds are generally known as polycrystalline diamond compact cutters ("PDCs"). Other materials, including, but not limited to, cubic boron nitride (CBN) and thermally stable polycrystalline diamond (TSP), may be used for the cutting edge of the plurality of cutter devices 122, 142. These plurality of cutter devices 122, 142 may be embedded in pockets in the first cutter section 120 and the second cutter section 140. The cutting edge of the plurality of cutter devices 122, 142 may be flat-faced or dome-shaped. Alternatively, the cutter devices 122, 142 may be fabricated from tungsten carbide. In one embodiment, the cutting edge of the cutter devices may be dome-shaped.

According to this embodiment, the force balanced asymmetric drilling reamer 100 has a first cutter section 120 and a second cutter section 140, thereby making the force balanced asymmetric drilling reamer 100 behave as a forward and reverse drilling reamer. In another embodiment, the force balanced asymmetric drilling reamer 100 has a first cutter section 120 only without a second cutter section 140, thereby making the force balanced asymmetric drilling reamer 100 behave as a reverse drilling reamer. In a further embodiment, the force balanced asymmetric drilling reamer 100 has a second cutter section 140 only without having a first cutter section 120, thereby making the force balanced asymmetric drilling reamer 100 behave as a forward drilling reamer.

The gage section 130 has an outer diameter which is dimensioned to a full wellbore diameter. In other words, the diameter of the gage section 130 is substantially the same as the wellbore diameter formed by the drill bit (not shown) that is coupled to the end of the drill string (not shown). The gage section 130 comprises a plurality of gage inserts 132, which can provide conventional gage protection and stabilization of the wellbore. These plurality of gage inserts 132 may be radially and vertically aligned on the outer surface of the gage section 130. Although these plurality of gage inserts 132 have been described as being radially and vertically aligned, the plurality of gage inserts 132 may be vertically and/or radially staggered without departing from the scope and spirit of the exemplary embodiment. It is understood that the number and orientation of the gage elements 132 may be greater or fewer than from that shown in the accompanying figure without departing from the scope and spirit of the exemplary embodiment.

The plurality of gage inserts 132 may be made from low-friction tungsten carbide buttons. Although low-friction tungsten carbide buttons have been illustrated for use as gage inserts, other materials used for gage protection, including but not limited to nylon, Teflon posts, and other low-friction inserts, may be used for the gage inserts without departing from the scope and spirit of the exemplary embodiment. The top surfaces of the plurality of gage inserts 132 may be flat-faced or dome-shaped. Although the top surfaces of the plurality of gage inserts 132 have been described as being flat-faced or dome-shaped, any other shape may be used so that the least amount of torque or cutting action is created against the surface of the wellbore when the force balanced asymmetric drilling reamer 100 proceeds through the wellbore.

Additionally, these plurality of gage inserts 132 are inserted into the gage section 130 so that the outer edges of the plurality of gage inserts 132 are substantially flush with respect to the outer surface of the gage section 130. Thus, the gage section 130 is designed to be as passive as possible in order to minimize potential damage to desirable wellbore conditions.

The plurality of blades 112 are designed to be asymmetric to each other. Thus, an angle formed between at least one set of consecutive blades of the plurality of blades 112 is different than at least one other angle formed between a different set of consecutive blades of the plurality of blades 112, where one of the blades may or may not be a common blade to the two sets of consecutive blades. Asymmetrical blades 112 can reduce development of a lobed pattern lateral movement cycle which can damage the tools and the condition of the borehole wall. These asymmetrical blades 112 may be force balanced under several different cutting conditions.

Under one such cutting condition, the entire force balanced asymmetric drilling reamer 100 is force balanced within the cross-sectional area located between the outermost diameter 118 to the innermost diameter 119, in an additive incremental step 108. The distance between the outermost diameter 118 and the innermost diameter 119 is represented by "D" 106. The value of "D" is determined by various drilling conditions, the diameter of the drill string, and the diameter of the drill bit. The additive incremental step 108 is represented by "IS" 108. The value of "IS" is a user chosen value, which may differ from one application to another. In one embodiment, the "IS" value is one hundred thousandths of an inch. Thus, the radial forces of the cutting devices 122, 142 and the gage inserts 132 are force balanced in additive incremental steps "IS" starting from the outermost diameter 118 and moving towards the innermost diameter 119. In other words, the radial forces occurring within the cross-sectional area found within the first "IS" distance from the outermost diameter 118 are force balanced so that the resultant radial force for that cross-sectional area is less than 10% of Weight on Bit ("WOB") with respect to the center of rotation axis 105. Additionally, the radial forces occurring within the cross-sectional area found within two "IS" distances from the outermost diameter 118 are force balanced so that the resultant radial force for that cross-sectional area is less than 10% of WOB with respect to the center of rotation axis 105. Further, the radial forces occurring within the cross-sectional area found within three "IS" distances from the outermost diameter 118 are force balanced so that the resultant radial force for that cross-sectional area is less than 10% of WOB with respect to the center of rotation axis 105. These radial forces are continuously force balanced in the manner described until the innermost diameter 119 is reached. Additionally, according to another embodiment, the force balancing may provide a resultant radial force for a desired cross-sectional area to be less than 5% of WOB. Additionally, according to another embodiment, the force balancing may provide a resultant radial force for a desired cross-sectional area to be less than 1% of WOB.

Although one embodiment has been provided wherein the entire force balanced asymmetric drilling reamer 100 is force balanced from its outermost diameter 118 to its innermost diameter 119, another embodiment may have radial forces force balanced for only a portion of the distance between the outermost diameter 118 and the innermost diameter 119. For example, in certain cutting conditions, only the radial forces found within a distance of 0.25" from the outermost diameter 118 of the force balanced asymmetric drilling reamer 100 are force balanced as a result of the wellbore swell being 0.25" or less. In another example, only the radial forces found within a distance of 0.50" from the outermost diameter 118 of the force balanced asymmetric drilling reamer 100 are force balanced as a result of the wellbore swell being 0.50" or less. In yet another example, only the radial forces found within a distance of 0.75" from the outermost diameter 118 of the force balanced asymmetric drilling reamer 100 are force balanced as a result of the wellbore swell being 0.75" or less. This force balancing may be performed as a whole or in incremental steps.

The first connection end 180 is coupled to a threaded box connector 182. This threaded box connector 182 is designed to be coupled to a pin connector associated with another device or drill pipe. The second connection end 190 is coupled to a threaded pin connector 192. This threaded pin connector 192 is designed to be coupled to a threaded box connector associated with another device or drill pipe. Although the first connection end 180 is shown to be coupled to a threaded box connector 182, the first connection end 180 may be coupled to a threaded pin connector or any other connector types known to those of ordinary skill in the art without departing from the scope and spirit of the exemplary embodiment. Additionally, although the second connection end 190 is shown to be coupled to a threaded pin connector 192, the second connection end 190 may be coupled to a threaded box connector or any other connector types known to those of ordinary skill in the art without departing from the scope and spirit of the exemplary embodiment.

Optionally, the entire force balanced asymmetric drilling reamer 100 may be treated by nitriding to provide an electrically charged surface similar to the charge of the shale cuttings or other cuttings found in the wellbore. Hence, the force balanced asymmetric drilling reamer 100 will repel the shale cuttings and prevent the shale cuttings from adhering to the surface of the force balanced asymmetric drilling reamer 100. For example, if the shale cuttings have a negative charge, the force balanced asymmetric drilling reamer 100 may be treated such that it also exhibits a negative charge for repelling the shale cuttings. In effect, this may provide better efficiency at agitating and opening the borehole. In an alternative embodiment, at least a portion of the surface of the force balanced asymmetric drilling reamer 100 may be treated by nitriding. U.S. Pat. No. 5,330,016 (the "'016 Patent"), issued to Paske et al. on Jul. 19, 1994, discloses a method of treating a surface by nitriding to obtain the desired result. The teachings disclosed in the '016 Patent are incorporated by reference herein.

Figure 2:
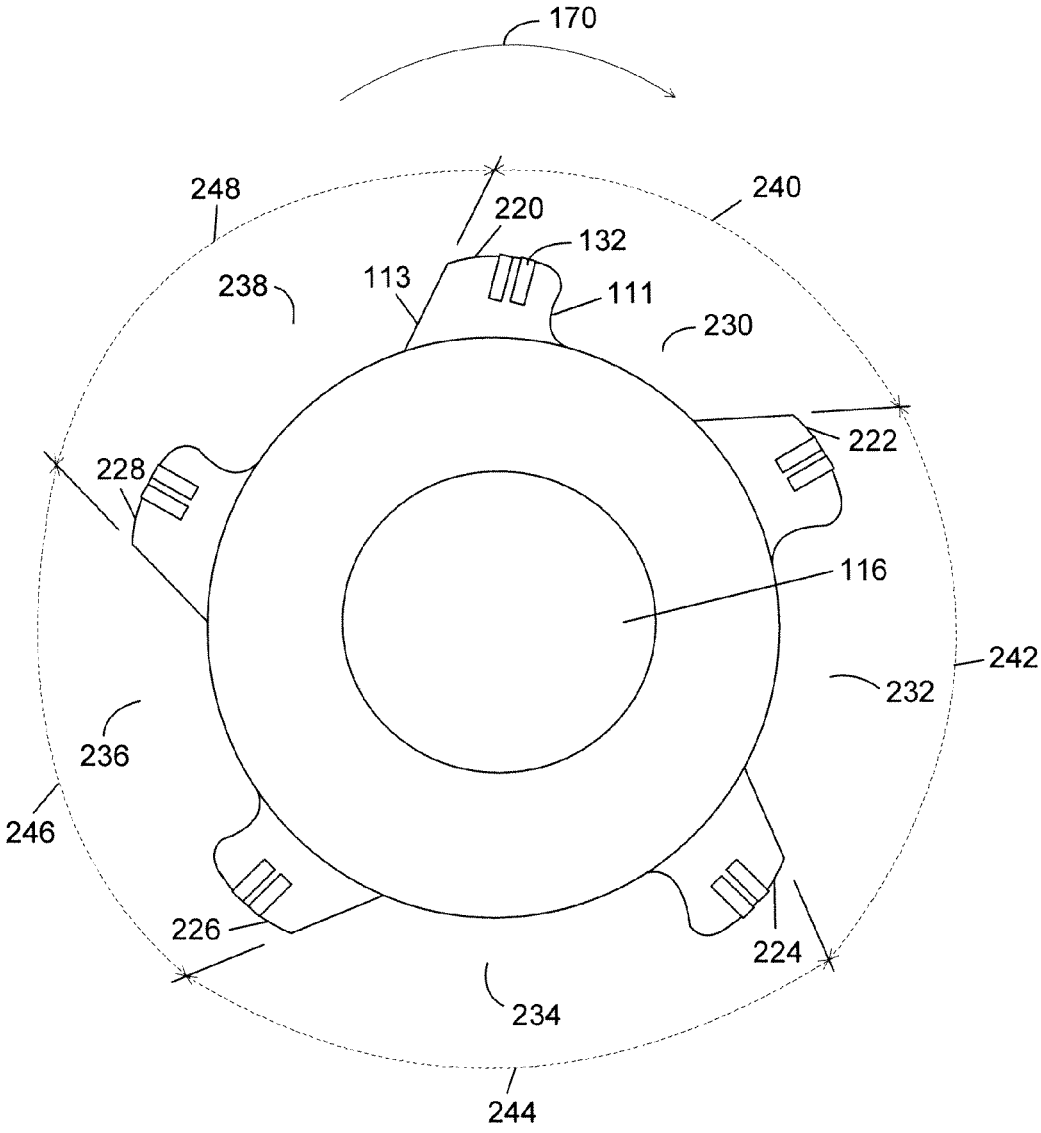
FIG. 2 shows a top view of the force balanced asymmetric drilling reamer illustrated in FIG. 1 that has been sectioned through its center in accordance with an exemplary embodiment.

FIG. 2 shows a top view of the force balanced asymmetric drilling reamer illustrated in FIG. 1 that has been sectioned through its center in accordance with an exemplary embodiment. This figure illustrates the asymmetrical configuration of the plurality of blades 112 as seen in FIG. 1. As seen in this embodiment, there are five blades 220, 222, 224, 226, 228 and five passageways 230, 232, 234, 236, 238 positioned between each of the five blades 220, 222, 224, 226, 228. The angle formed between the first blade 220 and the second blade 222 is angle one 240. The angle formed between the second blade 222 and the third 224 blade is angle two 242. The angle formed between the third blade 224 and the fourth blade 226 is angle three 244. The angle formed between the fourth blade 226 and the fifth blade 228 is angle four 246. The angle formed between the fifth blade 228 and the first blade 220 is angle five 248. In one embodiment, angle one is 65°, angle two is 75°, angle three is 84°, angle four is 69°, and angle five is 72°. Although one specific example has been provided to illustrate blade asymmetry, other combinations of angles showing blade asymmetry are to be covered by this invention. For example, blade asymmetry exists when at least one angle between consecutive blades is different than at least one other angle between a different set of consecutive blades.

Although five blades and five passageways have been illustrated, there may be greater or fewer blades and passageways without departing from the scope and spirit of the exemplary embodiment.

The front rotational side 111 and the rear rotational side 113 may also be seen through this top cross-sectional view. According to this embodiment, the front rotational side 111 is scoop-shaped or concave shaped and the rear rotational side 113 is angularly linear. As previously discussed, these shapes may be reversed or modified without departing from the scope and spirit of the exemplary embodiment. Additionally, the gage inserts 132 are also shown to be flushly mounted to the outer surface of the gage section 130 (FIG. 1).

Figure 3:
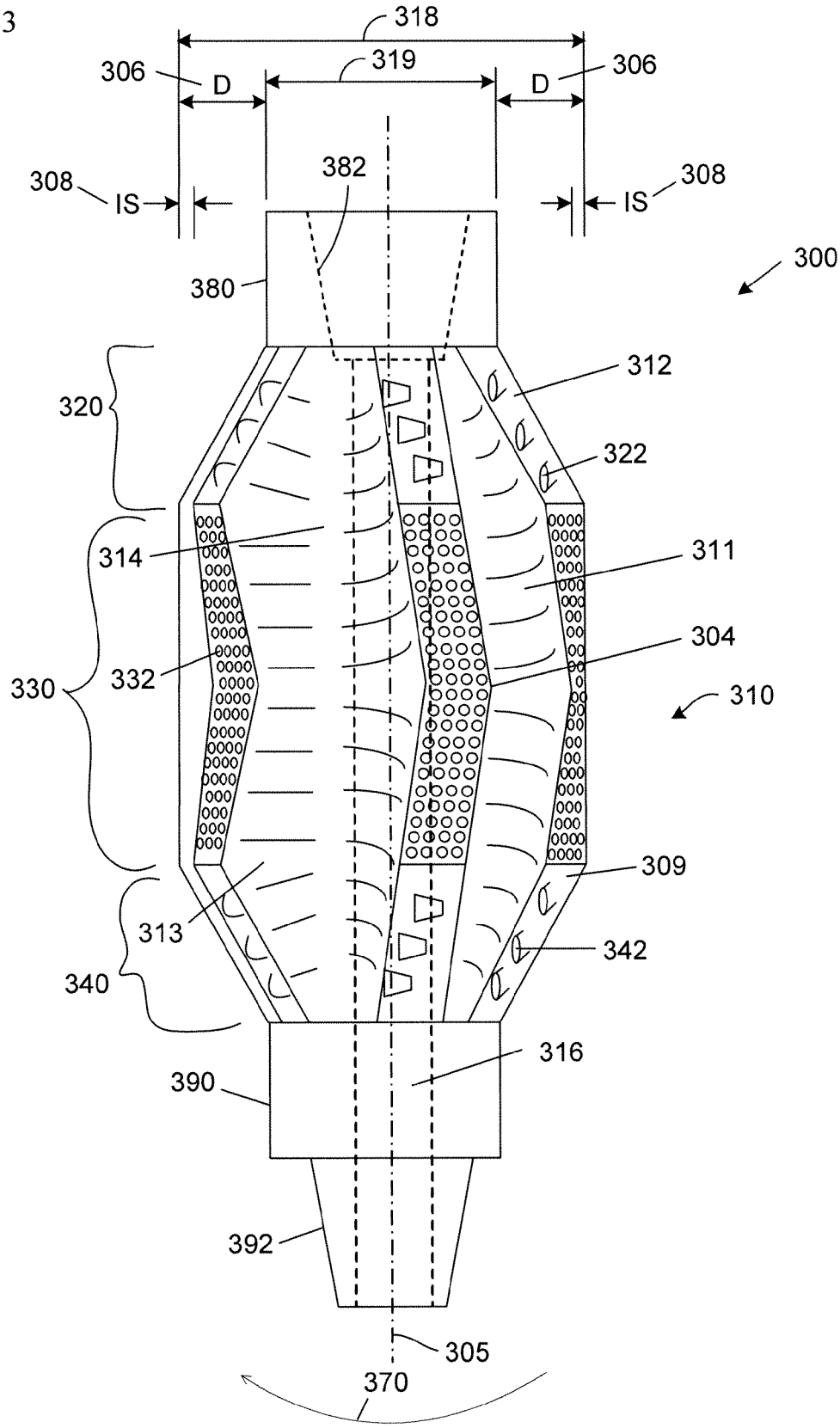
FIG. 3 shows a side view of a force balanced asymmetric drilling reamer in accordance with an exemplary embodiment.

FIG. 3 shows a side view of a force balanced asymmetric drilling reamer 300 in accordance with an exemplary embodiment. The force balanced asymmetric drilling reamer 300 includes a body 310 having a center of rotation axis 305, a bore channel 316 for passage of drilling fluids there through, a first connection end 380, and a second connection end 390. The bore channel 316 is created longitudinally parallel to the center of rotation axis 305 and is dimensioned to a desired sized to allow smooth passage of drilling fluids there through. The center of rotation axis 305 passes within the bore channel 316. Some factors influencing the size of the bore channel 316 includes, but is not limited to, drill string size, wellbore diameter, and the properties of the drilling fluids. In an exemplary embodiment, the bore channel 316 has a circular geometric shape. However, it is understood that bore channels having alternative geometric shapes, including but not limited to square and rectangular geometric shapes, are within the scope and spirit of the exemplary embodiment.

The body 310 includes a plurality of blades 312 and a plurality of passageways 314, wherein each of the plurality of passageways 314 is positioned between each of the plurality of blades 312. These plurality of blades 312 may be coupled to the body 310 or may be integrally formed into the body 310. Additionally, the plurality of blades 312 may be boomerang/chevron shaped as shown in FIG. 3, or may have alternative shapes, including but not limited to straight, spiraled, or curve shaped, without departing from the scope and spirit of the exemplary embodiment. According to this embodiment, the plurality of blades 312 are boomerang/chevron shaped, wherein the apex 304 of the boomerang/chevron shape is located away from the direction of rotation 370. Although the apex 304 has been illustrated as being located away from the direction of rotation 370, the apex 304 may be located in the direction of rotation 370 without departing from the scope and spirit of the exemplary embodiment.

Each of the plurality of blades 312 comprises a front rotational side 311 located on the side facing the direction of rotation 370, a blade cutting surface 309, and a rear rotational side 313 located on the side facing away from the direction of rotation 370. According to the embodiment shown in FIG. 3, the front rotational side 311 may have a scoop-shape or concave shape, which thereby allows the force balanced asymmetric drilling reamer 300 to behave as an agitator. The front rotational side 311 scoops up the drilling fluids and cutting settlings located in the wellbore and creates turbulence to prevent and/or clear constrictions caused by cutting settlings. These cutting settlings may then be allowed to travel back to the surface of the wellbore or to any other location where drilling fluids are processed. The rear rotational side 313 is illustrated to be linear, which may either proceed directly towards the center of rotation axis 305 or may proceed angularly with respect to the center of rotation axis 305. Although this embodiment shows the rear rotational side 313 to be linear, the rear rotational side 313 may alternatively be concave shaped, convex shaped, or a combination of concave shaped, convex shaped, and linear without departing from the scope and spirit of the exemplary embodiment. Additionally, the shapes of the front rotational side 311 and the rear rotational side 313 may be switched such that the front rotational side 311 has a convex shape or straight shape, in lieu of the concave shape, without departing from the scope and spirit of the exemplary embodiment.

Each of the blade cutting surface 309 for the plurality of blades 312 comprises a first cutter section 320, a second cutter section 340, and a gage section 330 positioned between the first cutter section 320 and the second cutter section 340. The first cutter section 320 is distally located to the drill bit (not shown) and the second cutter section 340 is proximally located to the drill bit (not shown) when the force balanced asymmetric drilling reamer 300 is coupled along the drill string (not shown). According to some embodiments, the force balanced asymmetric drilling reamer 300 is located approximately between 100 feet to approximately 200 feet above the drill bit (not shown). Although one example has been provided for a distance typically separating the drill bit (not shown) and the force balanced asymmetric drilling reamer 300, the separation distance may be shorter or longer depending upon the requirements of the application without departing from the scope and spirit of the exemplary embodiment.

According to the embodiment shown, the first cutter section 320 and the second cutter section 340 are both tapered and extend from the gage section 330 to the first connection end 380 and the second connection end 390, respectively. The diameter of the gage section 330 is larger than the diameters of the first connection end 380 and the second connection end 390. Although the first cutter section 320 and the second cutter section 340 are illustrated as being tapered, the first cutter section 320 and the second cutter section 340 may be convex shaped, or include alternative means of reducing the outer diameter of the body 310 while proceeding from the gage section 330 to the first connection end 380 and the second connection end 390, without departing from the scope and spirit of the exemplary embodiment. In certain embodiments, one cutter section may be tapered while the other cutter section is convex shaped without departing from the scope and spirit of the exemplary embodiment. The first cutter section 320 and the second cutter section 340 have a reduced diameter relative to the gage section 330 of the body 310.

The outer surfaces of the first cutter section 320 and the second cutter section 340 comprise a plurality of cutter devices 322, 342, which can deform the earth formation by scraping and shearing. These plurality of cutter devices 322, 342 may be radially and vertically staggered on the outer surfaces of the first cutter section 320 and the second cutter section 340. Additionally, these plurality of cutter devices 322, 342 are substantially exposed above the outer surfaces of the first cutter section 320 and the second cutter section 340 to provide maximum effectiveness in opening the bore constriction. Although these plurality of cutter devices 322, 342 have been described as being radially and vertically staggered, the plurality of cutter devices 322, 342 may be only vertically staggered, only radially staggered, or having a staggered positioning on only one of the cutter sections, without departing from the scope and spirit of the exemplary embodiment. It is understood that the number and orientation of the cutter devices may differ from that shown in the accompanying figure without departing from the scope and spirit of the exemplary embodiment. It is understood that the number and orientation of the cutter devices 322, 342 may be greater or fewer than from that shown in the accompanying figure without departing from the scope and spirit of the exemplary embodiment.

The cutting edge of the plurality of cutter devices 322, 342 may be made from hard cutting elements, such as natural or synthetic diamonds. The cutter devices made from synthetic diamonds are generally known as PDCs. Other materials, including, but not limited to, CBN and TSP, may be used for the cutting edge of the plurality of cutter devices 322, 342. These plurality of cutter devices 322, 342 may be embedded in pockets in the first cutter section 320 and the second cutter section 340. The cutting edge of the plurality of cutter devices 322, 342 may be flat-faced or dome-shaped. Alternatively, the cutter devices 322, 342 may be fabricated from tungsten carbide.

According to this embodiment, the force balanced asymmetric drilling reamer 300 has a first cutter section 320 and a second cutter section 340, thereby making the force balanced asymmetric drilling reamer 300 behave as a forward and reverse drilling reamer. In another embodiment, the force balanced asymmetric drilling reamer 300 has a first cutter section 320 only without a second cutter section 340, thereby making the force balanced asymmetric drilling reamer 300 behave as a reverse drilling reamer. In a further embodiment, the force balanced asymmetric drilling reamer 300 has a second cutter section 340 only without having a first cutter section 320, thereby making the force balanced asymmetric drilling reamer 300 behave as a forward drilling reamer.

The gage section 330 has an outer diameter which is dimensioned to a full wellbore diameter. In other words, the diameter of the gage section 330 is substantially the same as the wellbore diameter formed by the drill bit (not shown) that is coupled to the end of the drill string (not shown). The gage section 330 comprises a plurality of gage inserts 332, which can provide conventional gage protection and stabilization of the wellbore. These plurality of gage inserts 332 may be radially and vertically aligned on the outer surface of the gage section 330. Although these plurality of gage inserts 332 have been described as being radially and vertically aligned, the plurality of gage inserts 332 may be vertically and/or radially staggered without departing from the scope and spirit of the exemplary embodiment. It is understood that the number and orientation of the gage inserts 332 may be greater or fewer than from that shown in the accompanying figure without departing from the scope and spirit of the exemplary embodiment.

The plurality of gage inserts 332 may be made from low-friction tungsten carbide buttons. Although low-friction tungsten carbide buttons have been illustrated for use as gage inserts, other materials used for gage protection, including but not limited to nylon, Teflon posts, and other low-friction inserts, may be used for the gage inserts without departing from the scope and spirit of the exemplary embodiment. The top surfaces of the plurality of gage inserts 332 may be flat-faced or dome-shaped. Although the top surfaces of the plurality of gage inserts 332 have been described as being flat-faced or dome-shaped, any other shape may be used so that the least amount of torque or cutting action is created against the surface of the wellbore when the force balanced asymmetric drilling reamer 300 proceeds through the wellbore.

Additionally, these plurality of gage inserts 332 are inserted into the gage section 330 so that the outer edges of the plurality of gage inserts 332 are substantially flush with respect to the outer surface of the gage section 330. Thus, the gage section 330 is designed to be as passive as possible in order to minimize potential damage to desirable wellbore conditions.

The plurality of blades 312 are designed to be asymmetric to each other, which has previously been illustrated and described with respect to FIG. 2. Thus, an angle formed between at least one set of consecutive blades of the plurality of blades 312 is different than at least one other angle formed between a different set of consecutive blades of the plurality of blades 312, where one of the blades may or may not be a common blade to the two sets of consecutive blades. As previously mentioned, asymmetrical blades 312 can reduce development of a lobed pattern lateral movement cycle which can damage the tools and the condition of the borehole wall. These asymmetrical blades 312 may be force balanced under several different cutting conditions.

Under one such cutting condition, the entire force balanced asymmetric drilling reamer 300 is force balanced within the cross-sectional area located between the outermost diameter 318 to the innermost diameter 319, in an additive incremental step 308. The distance between the outermost diameter 318 and the innermost diameter 319 is represented by "D" 306. The value of "D" is determined by various drilling conditions, the diameter of the drill string, and the diameter of the drill bit. The additive incremental step 308 is represented by "IS" 308. The value of "IS" is a user chosen value, which may differ from one application to another. In one embodiment, the "IS" value is one hundred thousandths of an inch. Thus, the radial forces of the cutting devices 322, 342 and the gage inserts 332 are force balanced in additive incremental steps "IS" starting from the outermost diameter 318 and moving towards the innermost diameter 319. In other words, the radial forces occurring within the cross-sectional area found within the first "IS" distance from the outermost diameter 318 are force balanced so that the resultant radial force for that cross-sectional area is less than 10% of WOB with respect to the center of rotation axis 305. Additionally, the radial forces occurring within the cross-sectional area found within two "IS" distances from the outermost diameter 318 are force balanced so that the resultant radial force for that cross-sectional area is less than 10% of WOB with respect to the center of rotation axis 305. Further, the radial forces occurring within the cross-sectional area found within three "IS" distances from the outermost diameter 318 are force balanced so that the resultant radial force for that cross-sectional area is less than 10% of WOB with respect to the center of rotation axis 305. These radial forces are continuously force balanced in the manner described until the innermost diameter 319 is reached. Additionally, according to another embodiment, the force balancing may provide a resultant radial force for a desired cross-sectional area to be less than 5% of WOB. Additionally, according to another embodiment, the force balancing may provide a resultant radial force for a desired cross-sectional area to be less than 1% of WOB.

Although one embodiment has been provided wherein the entire force balanced asymmetric drilling reamer 300 is force balanced from its outermost diameter 318 to its innermost diameter 319, another embodiment may have radial forces force balanced for only a portion of the distance between the outermost diameter 318 and the innermost diameter 319. For example, in certain cutting conditions, only the radial forces found within a distance of 0.25" from the outermost diameter 318 of the force balanced asymmetric drilling reamer 300 are force balanced as a result of the wellbore swell being 0.25" or less. In another example, only the radial forces found within a distance of 0.50" from the outermost diameter 318 of the force balanced asymmetric drilling reamer 300 are force balanced as a result of the wellbore swell being 0.50" or less. In yet another example, only radial forces found within a distance of 0.75" from the outermost diameter 318 of the force balanced asymmetric drilling reamer 300 are force balanced as a result of the wellbore swell being 0.75" or less. This force balancing may be performed as a whole or in incremental steps.

The first connection end 380 is coupled to a threaded box connector 382. This threaded box connector 382 is designed to be coupled to a pin connector associated with another device or drill pipe. The second connection end 390 is coupled to a threaded pin connector 392. This threaded pin connector 392 is designed to be coupled to a threaded box connector associated with another device or drill pipe. Although the first connection end 380 is shown to be coupled to a threaded box connector 382, the first connection end 380 may be coupled to a threaded pin connector or any other connector types known to those of ordinary skill in the art without departing from the scope and spirit of the exemplary embodiment. Additionally, although the second connection end 390 is shown to be coupled to a threaded pin connector 392, the second connection end 390 may be coupled to a threaded box connector or any other connector types known to those of ordinary skill in the art without departing from the scope and spirit of the exemplary embodiment.

Optionally, the entire force balanced asymmetric drilling reamer 300 may be treated by nitriding to provide an electrically charged surface similar to the charge of the shale cuttings or other cuttings found in the wellbore. Hence, the force balanced asymmetric drilling reamer 300 will repel the shale cuttings and prevent the shale cuttings from adhering to the surface of the force balanced asymmetric drilling reamer 300. For example, if the shale cuttings have a negative charge, the force balanced asymmetric drilling reamer 300 may be treated such that it also exhibits a negative charge for repelling the shale cuttings. In effect, this may provide better efficiency at agitating and opening the borehole. In an alternative embodiment, at least a portion of the surface of the force balanced asymmetric drilling reamer 300 may be treated by nitriding.

The force balanced asymmetric drilling reamer 100, 300 combines the functionalities of traditional string reamers, traditional cutting bed impellers, smooth gage stabilizers, and whirl resistant drill bits to create a downhole tool capable of addressing several different downhole drilling problems while causing minimal disturbance of quality wellbore surfaces. The force balanced asymmetric drilling reamer 100, 300 is essentially passive when passing through full gage, smooth wellbores. However, the force balanced asymmetric drilling reamer 100, 300 becomes essentially active when it encounters swelling formations, sloughing formations, ledges, or built up cutting beds during the course of drilling ahead, or reaming back out of a wellbore. The force balanced asymmetric drilling reamer 100, 300 can be used in vertical, low angle directional, high angle directional, and lateral wells or well sections. The force balanced asymmetric drilling reamer 100, 300 can overcome multiple formation conditions that can lead to torque and drag problems or a stuck BHA.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A downhole tool, comprising:

a body comprising a first end, a second end, and a center of rotation extending longitudinally through the body; and a plurality of asymmetric blades extending the length of the body and extending radially outwards from the body, the plurality of asymmetric blades defining a passageway positioned between each of the plurality of asymmetric blades, the plurality of asymmetric blades having a direction of rotation, each of the plurality of asymmetric blades comprises a front rotational side, a blade cutting surface, and a rear rotational side, wherein the blade cutting surface of at least one of the plurality of asymmetric blades comprises:

a first cutter section located on at least one of the ends of the body, the first cutter section comprising a plurality of cutter devices, each of the plurality of cutter devices exerting a radial force; and a gage section located adjacent to the first cutter section, the gage section defining an outermost diameter of the downhole tool and comprising a plurality of gage inserts, the plurality of gage inserts being substantially flushly mounted to the outer surface of the gage section, each of the plurality of gage inserts exerting a radial force, wherein the sum of two or more radial forces is a resultant radial force, and wherein at least a portion of the plurality of cutter devices and at least a portion of the plurality of gage inserts are forced balanced via an additive incremental step starting from the outermost diameter, wherein the resultant radial force for each additive incremental step is less than 10% of weight on bit at a point along the center of rotation.

2. The downhole tool in accordance with claim 1, further comprising:

a second cutter section located on the other end of the body, wherein the gage section is disposed between the first cutter section and the second cutter section.

3. The downhole tool in accordance with claim 1, wherein the front rotational side is concave-shaped.

4. The downhole tool in accordance with claim 1, wherein the front rotational side is convex-shaped.

5. The downhole tool in accordance with claim 1, wherein the plurality of cutter devices are fabricated from at least one material selected from the group consisting of PDC cutters, cubic boron nitride cutters, thermally stable polycrystalline diamond cutters, and tungsten carbide inserts.

6. The downhole tool in accordance with claim 1, wherein the plurality of cutter devices comprise a shape selected from the group consisting of flat-faced and dome-shaped.

7. The downhole tool in accordance with claim 1, wherein the plurality of gage inserts are fabricated from at least one material selected from the group consisting of a low-friction tungsten carbide buttons, dome shaped PDC, nylon, and Teflon® posts.

8. The downhole tool in accordance with claim 1, wherein the plurality of gage inserts comprise a shape selected from the group consisting of flat-faced and dome-shaped.

9. The downhole tool in accordance with claim 1, wherein the outermost diameter is substantially uniform, the outermost diameter being a full bore diameter.

10. The downhole tool in accordance with claim 1, wherein the cutter section is tapered to an innermost diameter, the innermost diameter being smaller than the outermost diameter.

11. The downhole tool in accordance with claim 1, wherein each of the plurality of asymmetric blades is curve-shaped.

12. The downhole tool in accordance with claim 11, wherein each of the plurality of asymmetric blades comprises an apex, the apex positioned in the direction of rotation of the plurality of asymmetric blades.

13. The downhole tool in accordance with claim 11, wherein each of the plurality of asymmetric blades comprises an apex, the apex positioned away from direction of rotation of the plurality of asymmetric blades.

14. The downhole tool in accordance with claim 1, wherein each of the plurality of asymmetric blades is chevron-shaped.

15. The downhole tool in accordance with claim 14, wherein each of the plurality of asymmetric blades comprises an apex, the apex positioned in the direction of rotation of the plurality of asymmetric blades.

16. The downhole tool in accordance with claim 14, wherein each of the plurality of asymmetric blades comprises an apex, the apex positioned away from the direction of rotation of the plurality of asymmetric blades.

17. The downhole tool in accordance with claim 1, wherein the plurality of cutter devices and the plurality of gage inserts are forced balanced.

18. The downhole tool in accordance with claim 17, wherein the additive incremental step is approximately one hundred thousandths of an inch.

19. The downhole tool in accordance with claim 1, wherein the additive incremental step is approximately one hundred thousandths of an inch.

20. The downhole tool in accordance with claim 1, wherein at least a portion of the surface of the downhole tool is treated by nitriding.

21. A downhole tool, comprising:

a body comprising a first end, a second end, and a center of rotation extending longitudinally through the body;

a plurality of asymmetric blades extending the length of the body and extending radially outwards from the body, the plurality of asymmetric blades defining a passageway positioned between each of the plurality of asymmetric blades, the plurality of asymmetric blades having a direction of rotation, each of the plurality of asymmetric blades comprises a front rotational side, a blade cutting surface, and a rear rotational side, wherein the blade cutting surface of at least one of the plurality of asymmetric blades comprises:

a first cutter section located on at least one of the ends of the body, the first cutter section comprising a plurality of cutter devices, each of the plurality of cutter devices exerting a radial force; and a gage section located adjacent to the first cutter section, the gage section defining an outermost diameter of the downhole tool and comprising a plurality of gage inserts, the plurality of gage inserts being substantially flushly mounted to the outer surface of the gage section, each of the plurality of gage inserts exerting a radial force;

a first connector coupled to the first end of the body; and a second connector coupled to the second end of the body, wherein the sum of two or more radial forces is a resultant radial force, wherein at least a portion of the plurality of cutter devices and at least a portion of the plurality of gage inserts are forced balanced via an additive incremental step starting from the outermost diameter and proceeding inwardly towards the center of rotation, wherein the resultant radial force for each additive incremental step is less than 10% of weight on bit at a point along the center of rotation.

22. The downhole tool in accordance with claim 21, wherein the outermost diameter is substantially uniform, the outermost diameter being a full bore diameter.

23. The downhole tool in accordance with claim 21, wherein the front rotational side is concave-shaped.

24. The downhole tool in accordance with claim 21, wherein each of the plurality of asymmetric blades is curve-shaped.

25. The downhole tool in accordance with claim 24, wherein each of the plurality of asymmetric blades comprises an apex, the apex positioned in the direction of rotation of the plurality of asymmetric blades.

26. The downhole tool in accordance with claim 24, wherein each of the plurality of asymmetric blades comprises an apex, the apex positioned away from the direction of rotation of the plurality of asymmetric blades.

27. The downhole tool in accordance with claim 21, wherein each of the plurality of asymmetric blades is chevron-shaped.

28. The downhole tool in accordance with claim 27, wherein each of the plurality of asymmetric blades comprises an apex, the apex positioned in the direction of rotation of the plurality of asymmetric blades.

29. The downhole tool in accordance with claim 27, wherein each of the plurality of asymmetric blades comprises an apex, the apex positioned away from the direction of rotation of the plurality of asymmetric blades.

30. The downhole tool in accordance with claim 21, further comprising:

a second cutter section located on the other end of the body, wherein the gage section is disposed between the first cutter section and the second cutter section.

31. The downhole tool in accordance with claim 21, wherein the cutter section is tapered to an innermost diameter, the innermost diameter being smaller than the outermost diameter.

32. The downhole tool in accordance with claim 21, wherein at least a portion of the surface of the downhole tool is treated by nitriding.

33. A method for force balancing a downhole tool, comprising:

determining an additive incremental step for a downhole tool, the downhole tool comprising:

a body comprising a first end, a second end, and a center of rotation extending longitudinally through the body; and a plurality of asymmetric blades extending the length of the body and extending radially outwards from the body, the plurality of asymmetric blades defining a passageway positioned between each of the plurality of asymmetric blades, the plurality of asymmetric blades having a direction of rotation, each of the plurality of asymmetric blades comprises a front rotational side, a blade cutting surface, and a rear rotational side, wherein the blade cutting surface of at least one of the plurality of asymmetric blades comprises:

a first cutter section located on at least one of the ends of the body, the first cutter section comprising a plurality of cutter devices, each of the plurality of cutter devices exerting a radial force; and a gage section located adjacent to the first cutter section, the gage section defining an outermost diameter of the downhole tool and comprising a plurality of gage inserts, the plurality of gage inserts being substantially flushly mounted to the outer surface of the gage section, each of the plurality of gage inserts exerting a radial force;

wherein the sum of two or more radial forces is a resultant radial force; and force balancing at least a portion of the plurality of cutter devices and at least a portion of the plurality of gage inserts via an additive incremental step starting from the outermost diameter and proceeding inwardly towards the center of rotation, wherein the resultant radial force for each additive incremental step is less than 10% of weight on bit at a point along the center of rotation.

34. The method in accordance with claim 33, wherein the outermost diameter is substantially uniform, the outermost diameter being a full bore diameter.

35. The method in accordance with claim 33, wherein the front rotational side is concave-shaped.

36. The method in accordance with claim 33, wherein each of the plurality of asymmetric blades is curve-shaped.

37. The method in accordance with claim 36, wherein each of the plurality of asymmetric blades comprises an apex, the apex positioned in the direction of rotation of the plurality of asymmetric blades.

38. The method in accordance with claim 36, wherein each of the plurality of asymmetric blades comprises an apex, the apex positioned away from the direction of rotation of the plurality of asymmetric blades.

39. The method in accordance with claim 33, wherein each of the plurality of asymmetric blades is chevron-shaped.

40. The method in accordance with claim 39, wherein each of the plurality of asymmetric blades comprises an apex, the apex positioned in the direction of rotation of the plurality of asymmetric blades.

41. The method in accordance with claim 39, wherein each of the plurality of asymmetric blades comprises an apex, the apex positioned away from the direction of rotation of the plurality of asymmetric blades.

42. The method in accordance with claim 33, wherein the downhole tool further comprises:

a second cutter section located on the other end of the body, wherein the gage section is disposed between the first cutter section and the second cutter section.

43. The method in accordance with claim 33, wherein the cutter section is tapered to an innermost diameter, the innermost diameter being smaller than the outermost diameter.

44. The method in accordance with claim 33, further comprising treating at least a portion of the surface of the downhole tool by nitriding.

45. A downhole tool, comprising:

a body comprising a first end, a second end, and a center of rotation extending longitudinally through the body;

a plurality of asymmetric blades extending at least a portion of the length of the body and extending radially outwards from the body, the plurality of asymmetric blades defining a passageway positioned between each of the plurality of asymmetric blades, the plurality of asymmetric blades having an outermost diameter and a first innermost diameter being smaller than the outermost diameter; and a plurality of cutting elements disposed on at least one blade wherein a first cutting element is positioned at a different diameter than a second cutting element, each of the plurality of cutter elements exerting a radial force;

wherein the sum of two or more radial forces is a resultant radial force, and wherein at least a portion of the plurality of cutting elements is forced balanced via an additive incremental step starting from the outermost diameter and proceeding towards the center of rotation.

46. The downhole tool of claim 45, wherein the resultant radial force for each additive incremental step is less than 10% of weight on bit at a point along the center of rotation.

47. The downhole tool of claim 45, wherein the plurality of asymmetric blades further comprises a second innermost diameter being smaller than the outermost inner diameter, the first innermost diameter being positioned near the first end and the second innermost diameter being positioned near the second end, and wherein a third cutting element is positioned between the outermost diameter and the second innermost diameter.

* * * * *